US006155412A

United States Patent [19]

Le Bras et al.

[11] Patent Number: 6,155,412

[45] Date of Patent: Dec. 5, 2000

[54] WRAPAROUND MULTIPACK WITH CARRYING HANDLE

[75] Inventors: Philippe Le Bras, Chateauroux; Jean-Michel Garnier, Issoudun, both of France

[73] Assignee: The Mead Corporation, Dayton, Ohio

[21] Appl. No.: 09/341,816

[22] PCT Filed: Jan. 15, 1998

[86] PCT No.: PCT/US98/00724

§ 371 Date: Sep. 24, 1999

§ 102(e) Date: Sep. 24, 1999

[87] PCT Pub. No.: WO98/31601

PCT Pub. Date: Jul. 23, 1998

[30] Foreign Application Priority Data

Jan. 17, 1997 [GB] United Kingdom ..... 9700994

[51] Int. Cl.[7] ..... B65D 71/00

[52] U.S. Cl. ..... 206/199

[58] Field of Search ..... 206/140, 158, 206/162, 172, 175, 199, 427, 434, 194

[56] References Cited

U.S. PATENT DOCUMENTS

| | | | |
|---|---|---|---|
| 3,186,587 | 6/1965 | Englander et al. | 206/434 |
| 3,897,872 | 8/1975 | Graser | 206/199 |
| 5,158,177 | 10/1992 | Negelen et al. | 206/434 |
| 5,167,325 | 12/1992 | Sykora | 206/140 |

FOREIGN PATENT DOCUMENTS

| | | |
|---|---|---|
| 0 024 782 | 3/1981 | European Pat. Off. . |
| 0 456 448 | 11/1991 | European Pat. Off. . |
| 0 630 825 | 12/1994 | European Pat. Off. . |
| 2 148 917 | 3/1973 | France . |
| 2 361 279 | 3/1978 | France . |
| 2029381 | 12/1971 | Germany . |
| 93 09 237 U | 9/1993 | Germany . |

*Primary Examiner*—Jim Foster
*Attorney, Agent, or Firm*—Thomas A. Boshinski

[57] ABSTRACT

A carton accomodating a plurality of articles, such as bottles, comprising a top (16, 26), a base (12, 30) and a pair of side walls (14, 28) interconnecting said top and base thereby forming a tubular structure, said top being provided with two spaced rows of apertures (54, 56, 58, 60, 62, 64) through which the top portions of said articles protrude and a carrying handle means (18, 20, 22) extending upwardly from said top characterised in that said handle means is located between said two rows of apertures and is off set from a plane disposed midway between said rows of apertures.

12 Claims, 2 Drawing Sheets

WRAPAROUND MULTIPACK WITH CARRYING HANDLE

This invention relates to a carton of the wraparound type, accommodating a plurality of articles and which includes an upstanding carrying handle.

One aspect of the invention provides a carton accommodating a plurality of articles, such as bottles, comprising a top, a base and a pair of side walls interconnecting said top and base thereby forming a tubular structure, said top being provided with two spaced rows of apertures through which the top portions of said articles protrude and a carrying handle means extending upwardly from said top characterised in that said handle means is located between said two rows of apertures and is off set from a plane disposed midway between said rows of apertures.

According to an optional feature of this aspect of the invention, said carrying handle means may further comprise a pair of juxtaposed panels hinged together remote from said carton top to provide an upstanding handle, and tie means interconnecting lower portions of said carrying handle means to prevent said handle panels from moving apart about said hinged connection thereof said tie means comprising a tab struck from the junction of said top and one of said handle panels and wherein said tab is engaged in one of said apertures adjacent said opposing handle panel.

According to another optional feature of this aspect of the invention, said locking tab may be engaged in one of said apertures in said top and retained therein by the upper portion of one of said articles.

Another aspect of the invention provides a carton blank for accommodating a plurality of articles comprises a blank having a first base panel, a first side wall panel, a first top panel, first and second handle panels, a second top panel, a second side wall panel and a second base panel hinged respectively one to the next, said first and second base panel being interconnected thereby forming a carton of tubular structure and wherein said first and second handle panels form an upstanding handle, the apex of which is remote from said first and second top panels and which is off set from a transverse centre plane of said blank.

According to an optional feature of this aspect of the invention, said handle panel may be locked by tying means provided at or near the lower portion of said first and second handle panels which tying means prevents said handle panels from moving apart about the hinged connection.

An embodiment of the invention will now be described by way of example only with reference to the accompanying drawings in which.

Figure 1:
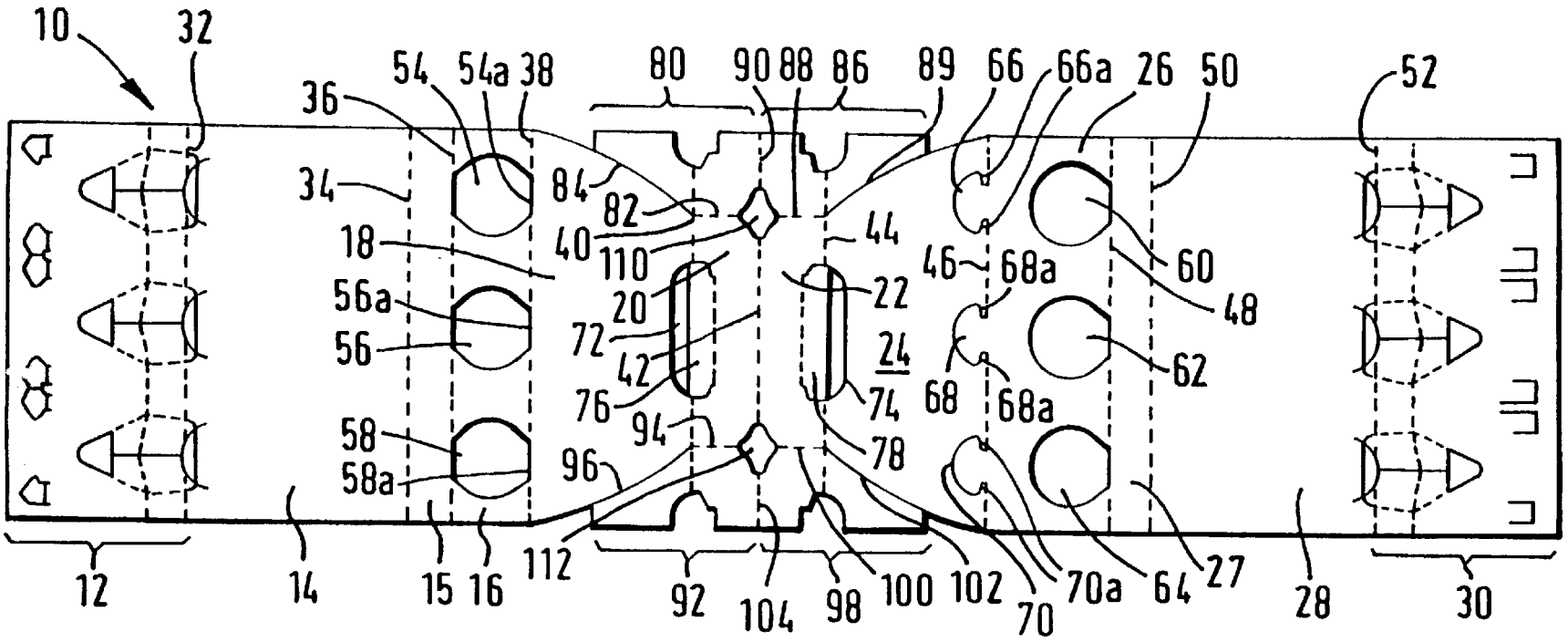
FIG. 1 is a plan view of a carton blank forming a carton according to the invention.

Referring to the drawings, and in particular FIG. 1 thereof, there comprises an elongate blank 10 formed from paperboard or like foldable sheet material comprises in series, a base structure 12, first side panel 14, intermediate panel 15, first top panel 16, first handle panel 18, a second handle panel 20, third handle panel 22, fourth handle panel 24, a second top panel 26, intermediate panel 27, a second side panel 28 and a second base structure 30 hingeably connected one to the next along transverse fold lines 32, 34, 36, 38, 40, 42, 44, 46, 48, 50 and 52 respectively.

The lower portions of the side panels 14, 28 and base panels forming the base structures 12, 30 are not described in any greater detail since they are not concerned with the present invention and are carton features well known in the art.

A series of three spaced bottle neck receiving apertures 54, 56 and 58 is struck from top panel 16 each of the apertures being shaped to provide a locking zone 54*a*, 56*a* and 58*a* respectively, adjacent the lower part of handle panel 18. Likewise, a series of three similarly spaced bottle neck receiving apertures 60, 62 and 64 is struck partially from top panel 26 but do not include locking zones.

Locking tabs 66, 68 and 70 are struck from handle panel 24 and are hinged to the lower end of handle panel 18 along the hinge line 46 and include D-shaped locking heads which have locking edges 66*a*, 68*a* and 70*a* respectively.

Handle panels 20 and 22 are each formed with handle apertures 72 and 74 which have hand cushioning flaps 76 and 78 respectively.

Reinforcing panel 80 is positioned adjacent to handle panels 18 and 20, being connected to handle panel 20 along fold line 82. Reinforcing panel 80 is separated from handle panel 18 by cut line 84 extending from fold line 40 to one of the side edges of handle panel 18. Reinforcing panel 86 is positioned adjacent to handle panels 22 and 24, being hingeably connected to handle 22 along fold line 88. Reinforcing panel 86 is separated from handle panel 24 by cut line 89 extending from fold line 44 to side edge of handle panel 24. Reinforcing panels 80 and 86 are hingeably connected together along their common side edge by fold line 90.

Reinforcing panel 92 is positioned adjacent to the opposite side edge of handle panels 18 and 20, being connected to handle panel 20 along fold line 94. Reinforcing panel 92 is separated from handle panel 18 by cut line 96 extending from fold line 40 to the side edge of handle panel 18. Reinforcing panel 98 is positioned adjacent to the opposite side of handle panels 22 and 24, being hingeably connected to handle 22 along fold line 100. Reinforcing panel 98 is separated from handle panel 24 by cut line 102 extending from fold line 44 to side edge of handle panel 24. Reinforcing panels 92 and 102 are hingeably connected together along their common side edge along fold line 104.

Optionally, apertures 110, 112 are struck from the common edges of reinforcing panels 80, 86 and 92, 98 respectively, thereby interrupting folding line 42 to make the folding easier during carton set up process described in greater detail below.

Figure 2:
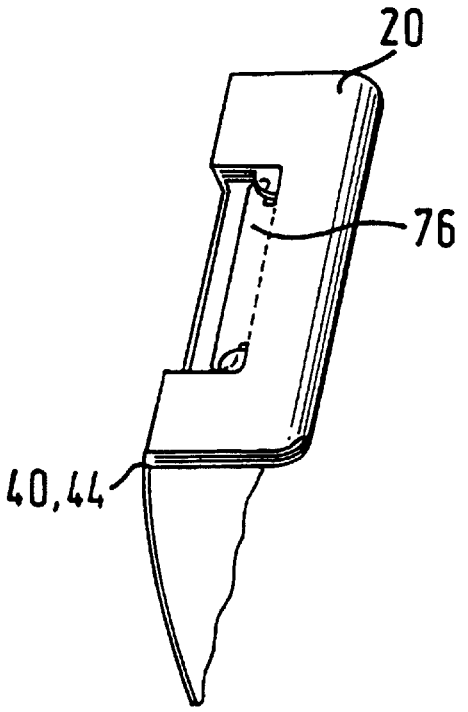
FIG. 2 is a perspective view showing the central portion of the carton incorporating an upstanding handle.
Figure 3:
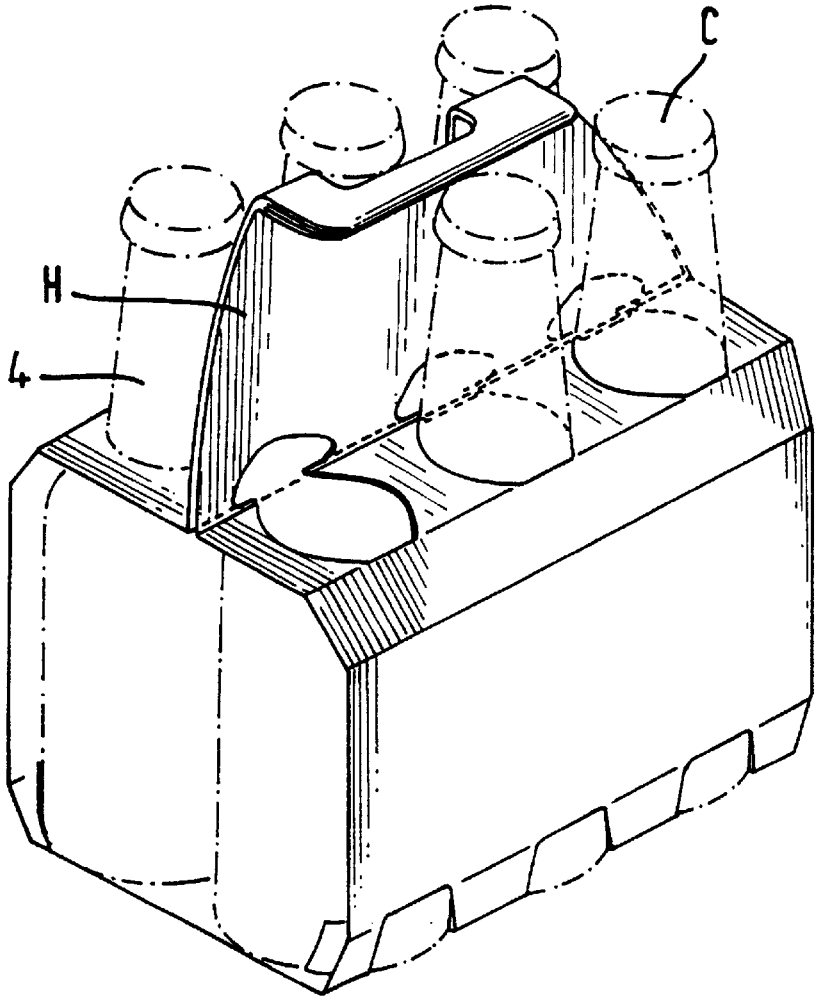
FIG. 3 is a perspective view of completed carton according to the invention but with one bottle removed to reveal one of the locking tabs.

The construction of a completed carrier of the invention shown in FIGS. 1 to 3 requires a series of sequential folding and gluing operations. The folding process is not limited to that described below and can be altered according to particular manufacturing requirements.

Thus, the blank is adapted to be wrapped about a group of six bottles arranged in two rows of three bottles each so that the neck portions 114 of the bottles shown in FIG. 3 protrude through the neck receiving apertures of the handle panels together form an upstanding handle H between the rows of bottles.

In order to apply the carton blank to the bottles, handle reinforcing panels 80, 86 are folded about fold lines 82, 88 respectively and into a face to face relationship with handle panels 18, 20 and 22, 24 respectively. Likewise, reinforcing panels 92, 98 are folded about fold lines 94, 100 and into a face to face relationship with handle panels 18, 20 and 22, 24 respectively.

Thereafter, the handle panels 18, 20 are erected into a juxtaposition out of the plane of the blank so that the handle apertures more or less are brought into registry with one another. In particular, locking tabs 66, 68 and 70 are folded about fold line 46 through 180 degrees and into a face to face relationship with top panel 26. Handle panels 18, 20 are folded about fold line 42 and brought into a face to face to relationship with handle panels 22, 24 respectively. Thus, locking tabs 66, 68 and 70 are aligned with apertures 54, 56 and 58.

The tabs are then interengaged with the apertures such that the heads of locking tab 66, 68 and 70 appear in respective ones of apertures 54, 56 and 58 with locking edges 66*a*, 68*a* and 70*a*, in locking engagement with locking zones 54*a*, 56*a* and 58*a* respectively.

Top panels 16 and 26 are folded out of alignment with the handle structure about fold lines 38 and 46 respectively. The blank is then applied to a group of bottles to be packaged so that handle H, shown in FIG. 3, formed from handle panels 18, 20 and 22, 24 is disposed between the rows of bottles being off set from a plane disposed mid-way between said rows of apertures.

At the position when the bottle neck receiving apertures are located above the tops of the associated bottles, the heads of the locking tabs 66, 68 and 70, interfere with the relative path of movement between the carton blank and rows of bottles to have their necks received in apertures 54, 56 and 58. The carton blank is then applied over the bottle necks whereby the heads of the locking tabs 66, 68 and 70 are outwardly displaced and disposed between handle panel 18 and the neck of an adjacent bottle. In FIG. 3, the first bottle of the nearest row is removed to show the general disposition of locking tab 66. Thus, handle panels 18 and 24 are tied together by locking tabs 66, 68, 70 so that they are maintained in virtually upright attitude for use.

It will be appreciated that by off-setting the handle H from a centre plane disposed midway between said rows of apertures, the stress placed on the locking tabs is decreased: extra handle strength is thereby provided. It will be understood by those skilled in the art that the invention is not limited to use with a carton incorporating locking tabs. Indeed, an "off-centre" handle can be applied to cartons of this type without locking tabs. Handle strength can be improved by using an "off-centre" handle.

The carton is completed into the form shown in FIG. 3, by causing side walls 14, 28 to be folded downward and the base structures 12 and 30 to be secured in an overlapping relationship beneath the base of the bottles. A hand cushioning structure S shown in FIG. 2 is provided between the registering handle apertures by flaps which are brought into overlapping relationship with two handle panels. optionally, handle panels 20, 22 are folded about fold line 40/44 and into a substantially perpendicular relationship illustrated in FIG. 2 to improve comfort for the user. For convenience purposes, the top of the handle is located above the bottle caps. Therefore, for stacking purposes handle panels 20, 22 are folded about fold line 40/44 and clipped against bottle caps C illustrated in FIG. 3.

In the arrangement described above, additional handle strength is provided by reinforcing panels 80, 86 and 92, 98.

The present invention and the preferred embodiment relates to an article carrier which is shaped to provide satisfactory strength to hold the bottles securely but with a degree of flexibility so that the load transferred to the handle is absorbed by the carrier. The shape of the blank minimises the amount of paperboard required. The carrier can be applied to an array of bottles by hand or automatic machinery. It is anticipated that the invention can be applied to a variety carriers and not limited to those of the type hereinbefore described.

What is claimed is:

1. A carton for accommodating a plurality of articles each having a top portion, comprising:

a top wall provided with first and second spaced rows of apertures through which said top portions of said articles protrude; and a carrying handle structure including a hand opening and located between said first and second rows, said handle structure connected at a lower end thereof to said top wall and extending upwardly from said top wall, wherein said lower end of said handle structure is located closer to said apertures in said first row than to said apertures in said second row so that said handle structure is offset from a plane disposed midway between said first and second rows.

2. The carton according to claim 1 wherein said apertures in said first row are disposed in contact with said lower end of said handle structure, and said apertures in said second row are spaced apart from said lower end of said handle structure.

3. The carton according to claim 1 wherein said top wall comprises a pair of first and second top panels disposed side by side to form said top wall, said first top panel being formed with said apertures in said first row, said second top panel being formed with said apertures in said second row, and said handle structure is interposed between said first and second top panels.

4. The carton according to claim 3 wherein said handle structure comprises a pair of juxtaposed handle panels hinged to said first and second top panels along first and second fold lines respectively, and the distance between said first fold line and said apertures in said first top panel is less than the distance between said second fold line and said apertures in said second top panel.

5. The carton according to claim 4 wherein said apertures in said first top panel are disposed in contact with said first fold line, and said apertures in said second top panel are spaced apart from said second fold line.

6. The carton according to claim 4 wherein said handle panels are disposed in a face to face contacting relationship with each other, and said second top panel has a securing tab engaged in one of said apertures in said first top panel to retain said handle panels in said contacting relationship.

7. The carton according to claim 6 wherein said securing tab is struck from an adjacent one of said handle panels and joined to said second top panel such that said second fold line is interrupted by said securing tab.

8. The carton according to claim 1 further comprising a base wall disposed below said top wall and a pair of side walls interconnecting said top and base walls to form a tubular structure.

9. A blank for forming a carton for accommodating a plurality of articles each having a top portion, said blank comprising first and second top panels and a pair of mutually hinged handle panels disposed between said first and second top panels, said first and second top panels being provided respectively with first and second rows of apertures for receiving said top portions of said articles, said handle panels being hinged to said first and second top panels along first and second fold lines respectively, said handle panels having respective hand openings to form when erected a carrying handle structure extending upwardly from said top panels, wherein the distance between said first fold line and said apertures in said first top panel is less than the distance between said second fold line and said apertures in said second top panel.

10. The blank according to claim 9 wherein said apertures in said first top panel are disposed in contact with said first fold line, and said apertures in said second top panel are spaced apart from said second fold line.

11. The blank according to claim 9 wherein said second top panel has a securing tab for engagement in one of said apertures in said first top panel.

12. The blank according to claim 11 wherein said securing tab is struck from an adjacent one of said handle panels and joined to said second top panel such that said second fold line is interrupted by said securing tab.

* * * * *